US005445301A

United States Patent [19]

Biedenharn, Jr.

[11] Patent Number: 5,445,301

[45] Date of Patent: Aug. 29, 1995

[54] COMBINATION BACKPACK AND STOOL

[76] Inventor: Eric C. Biedenharn, Jr., P.O. Box 669, Vicksburg, Miss. 39181-0669

[21] Appl. No.: 179,199

[22] Filed: Jan. 10, 1994

[51] Int. Cl.[6] ..... A45F 3/04; A45F 4/02

[52] U.S. Cl. ..... 224/155; 224/153; 297/129

[58] Field of Search ..... 224/153, 154, 155; 297/183, 129, 228.12

[56] References Cited

U.S. PATENT DOCUMENTS

| | | | |
|---|---|---|---|
| 2,327,288 | 8/1943 | Post | 297/183 |
| 2,843,185 | 7/1958 | Clem et al. . | |
| 2,922,465 | 1/1960 | Johansson et al. . | |
| 3,220,767 | 11/1965 | Hendrickson | 297/228.12 |
| 3,527,498 | 9/1970 | Werner . | |
| 3,662,932 | 5/1972 | Kerschner . | |
| 3,730,294 | 5/1973 | Thurmond . | |
| 3,902,640 | 9/1975 | Geiben . | |
| 4,059,207 | 11/1977 | Jackson et al. | 224/153 |
| 4,392,598 | 7/1983 | Dixon . | |
| 4,489,866 | 12/1984 | Korte . | |
| 4,607,882 | 8/1986 | Opsvik . | |
| 4,673,117 | 6/1987 | Calton | 224/153 |
| 4,676,548 | 6/1987 | Bradbury . | |
| 4,694,979 | 9/1987 | Ables . | |
| 4,773,574 | 9/1988 | Burgard . | |
| 4,883,206 | 11/1989 | Miller | 224/153 |
| 4,955,517 | 9/1990 | Maresca . | |
| 5,016,792 | 5/1991 | Jay | 224/153 |
| 5,062,557 | 11/1991 | Mahvi et al. . | |
| 5,156,310 | 10/1992 | Biedenharn, Jr. . | |
| 5,318,342 | 6/1994 | Hale | 297/129 |

FOREIGN PATENT DOCUMENTS

| | | | |
|---|---|---|---|
| 0163437 | 12/1985 | European Pat. Off. . | |
| 79433 | 11/1951 | Norway . | |
| 699602 | 11/1953 | United Kingdom . | |
| 1469054 | 3/1977 | United Kingdom | 297/129 |
| 2023412 | 1/1980 | United Kingdom . | |

*Primary Examiner*—Henry J. Recla
*Assistant Examiner*—Charles R. Eloshway
*Attorney, Agent, or Firm*—Nixon & Vanderhye

[57] ABSTRACT

A combination backpack and stool includes a frame having an upper seat portion which is downwardly curved and is formed of front and rear opposed frame panels and a number of cross supports which rigidly join the front and rear frame panels one to another. A fabric cover member covers the frame and includes an access opening which allows access through the fabric cover member and into an interior of said frame so that a user may store articles therewithin. A cushion member is interposed between the downwardly curved upper seat portion of the frame and a corresponding portion of the fabric cover member so that the user will have a comfortable seat when seated upon the upper seat portion of the frame. A pair of shoulder straps are connected to the frame and/or fabric cover member so as to allow the frame to be carried upon a person's back.

11 Claims, 1 Drawing Sheet

COMBINATION BACKPACK AND STOOL

CROSS-REFERENCE TO RELATED PATENTS

This application is related to U.S. Pat. Nos. 5,156,310 issued Oct. 20, 1992, and 5,186,372 issued on Feb. 16, 1993, the entire content of each being expressly incorporated hereinto by reference.

FIELD OF INVENTION

The present invention relates generally to backpacks. More specifically, the present invention relates to backpacks having the capability of also serving as a stool for the user.

BACKGROUND AND SUMMARY OF THE INVENTION

Backpacks are notoriously well known articles used in a variety of daily activities. For example, backpacks are typically used in outdoors activities (e.g., camping, hiking, rock climbing, fishing and the like) as a means of carrying articles the participant needs for the particular activity in which he or she is involved.

It is desirable and sometimes necessary for the participant to rest periodically during outdoors activities, especially when the outdoor activities involve strenuous physical exercise. However, oftentimes, the participant in the outdoors activity does not have a convenient and/or comfortable place to rest. Thus, it would be desirable if some means were available that was sufficiently transportable so as to be usable in outdoors activities, while at the same time providing the participant in the outdoors activities with a convenient and comfortable place to rest. Furthermore, it would be highly desirable if such means also enabled the participant to carry articles needed for particular outdoors activity.

Several proposals to accomplish the purposes set forth above have been proposed in the art. For example, in my earlier issued U.S. Patents identified above, there is disclosed a combination backpack and stool which has a frame which includes a seat-defining member upon which a user may sit, a ground-engageable member for supporting the frame upon a surface, and an upright pedestal member rigidly coupled to and between the seat-defining member and the ground-engageable member so as to establish a space therebetween. A flexible material encloses the defined space to provide a storage compartment for articles and a pair of shoulder straps are attached to the frame which allow a user to carry the frame in the form of a backpack. When periodically resting, however, the frame may be set upon the ground so that the user can sit and rest upon the seat-defining member.

U.S. Pat. No. 3,902,640 discloses a two section, semi-rigid backpack having a lower section comprising a structurally reinforced, molded open basket to which shoulder and waist straps are adjustably attached and having a contoured side adjacent the hiker's back. The upper section of the semi-rigid backpack is a structurally reinforced molded member which may be removed in order to serve as a camp stool (see, column 2, line 35).

U.S. Pat. Nos. 3,662,932, 2,843,185 and 2,922,465 each generally disclose backpacks having frame structures which include moveable frame members which enable the backpack to be converted into a stool.

While the prior art proposals may be satisfactory for their intended functions, some improvements are still needed in this art. For example, it would especially be helpful in terms of structural integrity if the backpack frame contained no movable parts in order to be placed into service as a stool. Furthermore, the prior proposals in this art do not suggest providing a cushioning effect to the user when seated. It is therefore towards fulfilling such needs that the present invention is directed.

Broadly, this invention relates to a combination backpack and stool in which no movable parts are needed in order for the backpack to also function as a stool. More particularly, the combination backpack and stool of this invention has a frame which includes an upper seat portion and a fabric covering member and between which a cushion member (e.g., a one-piece foam structure) is interposed. As such, the seat portion of the frame will provide significantly improved comfort levels to a user when seated thereupon. Most preferably, the upper seat portion of the frame is downwardly curved and the cushion member is provided with a conformingly shaped convexly curved lower surface.

Most preferably, the rear frame panel will be inwardly curved about a longitudinal axis so as to more closely fit the user's back profile against which it will be placed when in service as a backpack. In this regard, the cushion member will most preferably be provided with a portion which will extend beyond the inwardly curved rear frame panel so as to provide a pillow against which the user's head may bear when the backpack/stool is carried on the user's back. Furthermore, the cushion member will preferably have a substantially horizontal upper surface so as to provide a maximum of cushion thickness near the center of the seat and to impart an overall generally parallelpiped shape to the combination backpack and stool of this invention.

The fabric covering member is tautly supported by the underlying frame but is most preferably is removable therefrom so as to provide ease of cleaning or replacement. In this connection, the fabric cover member is most preferably attached to the frame using a two-part fastening system (e.g., snaps, Velcro® loop and pile fasteners or the like) disposed generally at each corner of the frame. Thus, one part of such a two-part fastening system will be associated with a respective corner of the frame, whereas the other mating part of the two-part fastening system will be attached to an interior region of the fabric covering member such that, when the fabric covering member is tautly supported on the frame, the respective two-part fasteners will mate with one another.

The cushion member is most preferably fixed to the frame but may be removable therefrom so as to likewise provide ease of cleaning or replacement. In this regard, the cushion member may be provided with an attachment system which, in the preferred embodiment, is comprise of a number of tabs sized to encircle a corresponding portion of the frame. The tab ends are provided with a two-part fastener (e.g., snaps, Velcro® loop and pile fabric fasteners, and the like) so that they are may be mated to one another and thereby attach the cushion member to the frame portion which is encircled by the tabs.

Further aspects and advantages of this invention will become more clear after careful consideration is given to the following detailed description of the preferred exemplary embodiment thereof.

BRIEF DESCRIPTION OF THE ACCOMPANYING DRAWINGS

Reference will hereinafter be made to the accompanying drawing wherein FIG. 1 is a perspective elevational view of a combination backpack and stool according to this invention.

DETAILED DESCRIPTION OF THE PREFERRED EXEMPLARY EMBODIMENT

Figure 1:
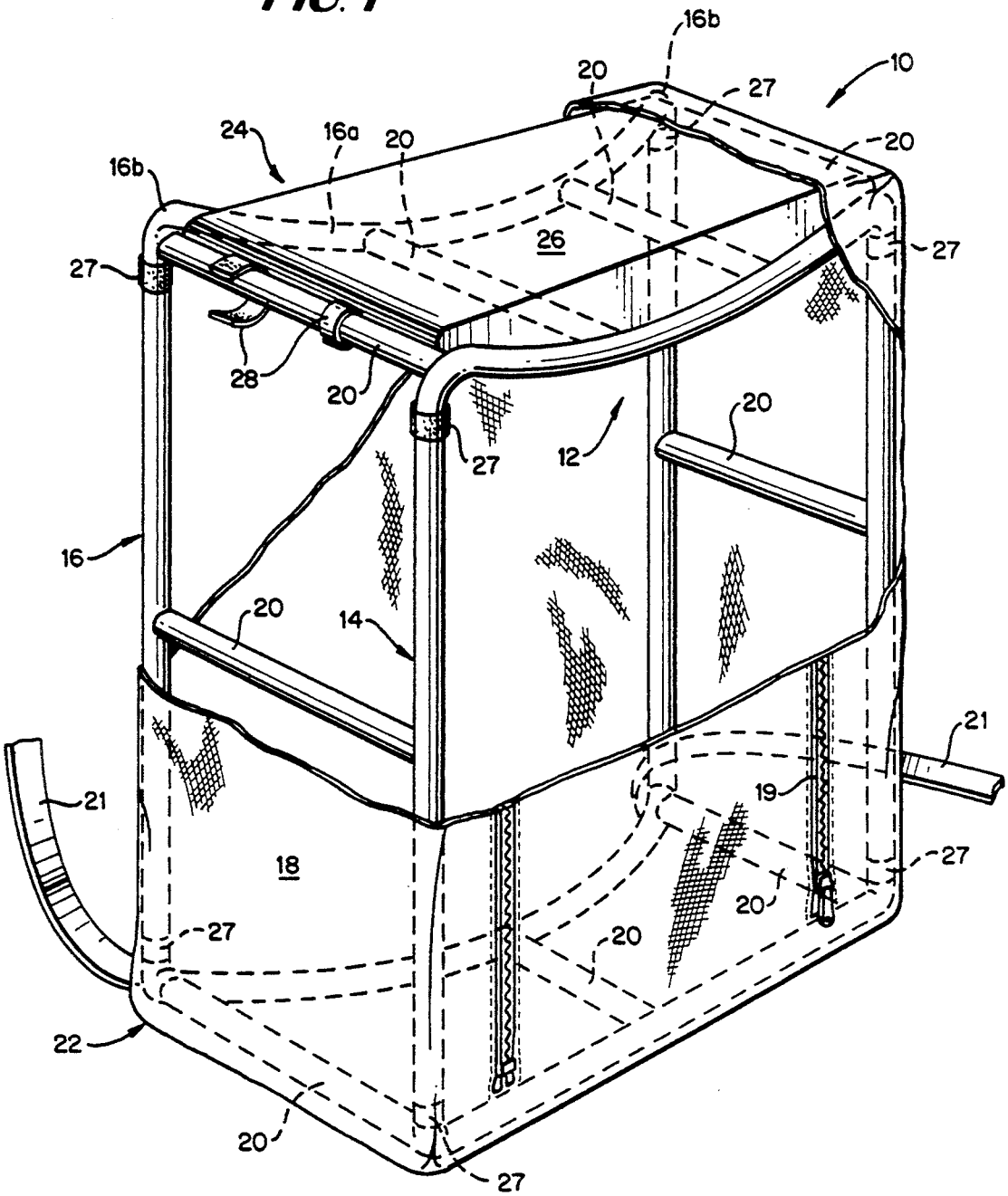

Accompanying FIG. 1 depicts a particularly preferred embodiment of the combination backpack and stool 10 according to this invention. As is seen, the backpack/stool 10 is generally comprised of a frame structure 12 having front and rear generally rectangular frame panels 14, 16, respectively and a fabric cover member 18 which is supported by and completely covers the frame 12. The frame 12 is rigid and most preferably is constructed of a material having sufficient strength to not only support the weight of articles stored in the backpack/stool 10, but also to support the user's weight when seated thereupon. For example, the frame 12 may be constructed of a metal (e.g., aluminum) or plastics material (e.g., polyolefins, nylons, polyacetals and the like) which should be selected so as to be as lightweight as possible. Additional light weight characteristics could be provided by forming the frame 12 from tubular (but high strength) members.

The front and rear frame panels 14, 16 are rigidly joined to one another by a number of cross supports 20. As a result, the fabric-covered frame will establish an internal space (or cavity) which may be accessed via a zippered opening 19 in the fabric cover 18 to allow the user to store articles that may be needed. The backpack/stool 10 may be carried upon the user's back via, a pair of shoulder straps 21 which are connected to at least one of the frame 12 and fabric cover 18. Although not shown in their entirety, it will be understood that each of the straps 21 is joined at each end to the lower and upper portions 22, 24, respectively, of the frame 12 so as to be generally vertically oriented.

The cross supports 20 are joined to the front and rear frame panels 14, 16 in any convenient fashion depending upon the material from which the frame is constructed. For example, if the frame 12 is constructed of a metal, then the various components of the frame may be joined to one another by welding, brazing, bolting and the like. On the other hand, if the frame is formed of a plastics material, then the various frame components may be joined to one another via bolting, adhesive welding or the like.

The lower portion 22 of the frame 12 is substantially flat so that it may stably be placed on the ground. The upper portion 24 of frame 12, however, establishes a seat region and is adapted to provide a comfortable surface upon which the user may sit (as will be explained in greater detail below). As is seen in FIG. 1, the upper portion of the front and rear frame panels 14, 16 is downwardly curved so that the cross supports 20 at the upper portion 24 of frame 12 generally establish the generatrices of a right cylindrical surface. The cross supports 20 at the curved upper portion 24 of frame 12 thereby serve to support a cushion member 26 (e.g., a one-piece foam structure) which provides a cushioned region upon which the user may sit. The rear frame panel 16 is most preferably curved about a longitudinal axis so as to conform more naturally to the user's back against which it will be placed when in use as a backpack.

The cushion member 26 itself preferably has a convex lower surface which conforms to the downwardly curved upper seat portion 24. However, in plan view the cushion member 26 is most preferably substantially rectangular. Since the uppermost member (designated by reference numeral **16*a*) forming the rear frame panel 16 is both downwardly and inwardly curved (i.e., so as to establish the seat portion of the frame and to conform to the user's back profile as described above), there will be a portion of the cushion member 26 which extends outwardly from the rear frame panel to a line generally drawn between the upper corners 16*b* of the rear frame panel 16. Therefore, this outwardly extending portion of the cushion member 26 will provide a comfortable pillow against which the user's head may bear when the backpack/stool 10 is carried on the user's back. In addition, the backpack/stool 10 could be positioned during periods of nonuse so that the front frame panel 14 is against the ground such that the outwardly extending portion of the cushion member 26** will provide a pillow when the user lies down on the ground to rest.

The fabric cover member 18 is sized so that it is supported in a taut condition by the frame 16. Thus, the fabric cover member 18 may be physically removed and separated from the supporting frame 16 so as to facilitate cleaning or replacement. In this connection, the fabric cover member 18 may be provided with zippered (or otherwise removable) panel so as to allow the entire cover member 18 to be more easily removed from the underlying frame 16. Although not absolutely required, the fabric cover member 18 may be physically (but removably) attached to the frame 16 by any suitable two-part fastening system. A Velcro® loop and pile fabric fastener 27 is shown schematically in FIG. 1, but any other two-part fastener may be employed (e.g., two-part snaps). The fastener system 27 is preferably positioned near each corner of the frame 16, with one part of the fastener 27 being physically attached to the frame 16 and another part physically attached to an interior region of the fabric cover member 18. In such a manner, the two parts of the fastener 27 will mate with one another when the fabric cover member is positioned on the supporting frame 16.

The cushion member 26 may be rigidly attached to the frame 12 (e.g., via adhesives or the like). Preferably, however, the cushion member 26 is removably interposed between the upper seat portion 24 of the frame 12 and the fabric cover 18. In this regard, any suitable attachment means may be provided to ensure removability of the cushion member 26. For example, a two-part snap and/or loop and pile fabric fastener system (e.g., Velcro® loop and pile fastener) may be provided for such purpose. In the embodiment shown in FIG. 1, there is shown an attachment means whereby the cushion member 26 is provided with tabs 28 which are sized so as to encircle an adjacent one of the cross supports 20. The ends of the tabs 28 each will be provided with one part of a two-part fastener —in this case a loop and pile fabric fastener. Thus, the ends of the tabs 28 may be joined to one another upon encircling an adjacent one of the cross supports 20 so as to removably connect the cushion member 26 to the frame 12.

The combination backpack/stool 10 described above may, of course, be fabricated in various sizes and overall geometric shapes without departing from the intent of this invention. Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combination backpack and stool comprising:

a frame having a downwardly curved upper seat potion and including front and rear opposed frame panels and a number of cross supports which rigidly join said front and rear frame panels one to another;

a fabric cover member covering said frame and including an access opening which allows access through the fabric cover member and into an interior of said frame;

a cushion member interposed between said upper seat portion of said frame and a corresponding portion of said fabric cover member; and a pair of shoulder straps connected to one of said frame and fabric cover member to allow the frame to be carried upon a person's back.

2. A combination backpack and stool as in claim 1, wherein said fabric cover member is removable from said frame.

3. A combination backpack and stool as in claim 2, wherein said fabric cover member and said frame are provided with a two-part fastener system whereby said cover member and said frame are removably attached to one another when said fabric cover member covers said frame.

4. A combination backpack and stool as in claim 1, wherein said cushion member has a convex lower surface which conforms to said downwardly curved upper seat portion.

5. A combination backpack and stool as in claim 4, wherein said rear frame panel is inwardly curved about a longitudinal axis so as to more closely conform to a user's back profile, and wherein said cushion member includes a portion which extends outwardly from said rear frame panel to provide a pillow for a user's head.

6. A combination backpack and stool as in claim 1, wherein said rear frame panel is inwardly curved about a longitudinal axis so as to more closely conform to a user's back profile, and wherein said cushion member includes a portion which extends, outwardly from said rear frame panel to provide a pillow for a user's head.

7. A combination backpack and stool as in claim 1, wherein said cushion member is on piece foam structure.

8. A combination backpack and stool as in claim 1, wherein said frame is formed of a tubular material.

9. A combination backpack and stool as in claim 8, wherein said frame is formed of a tubular material selected from the group consisting of tubular metal and tubular plastics material.

10. A combination backpack and stool comprising:

a frame having an upper seat portion and including front and rear opposed frame panels and a number of cross support which rigidly said front and rear frame panels one to another;

a fabric cover member covering said frame and including an access opening which allows access through the fabric cover member and into interior of said frame;

a cushion member removably insertable between said seat portion of said frame and said corresponding portion of said fabric cover member; and a pair of shoulder straps connected to one of said frame and fabric cover member to allow the frame to be carried upon a person's back, and wherein said cushion member includes an attachment system which removably attaches said cushion member to said frame, said attachment system including several tabs having a loop and pile fabric fastener which are sized so as to bound an adjacent portion of said frame and thereby removably attach said cushion member thereto.

11. A combination backpack and stool comprising:

a frame having an upper seat portion and including front and rear opposed frame panels and a number of cross supports which rigidly join said front and rear frame panels one to another.

a fabric cover member covering said frame and including an access opening which allows access through the fabric cover member and into an interior of said frame, said access opening including a zipper closure device;

a cushion member interposed between said upper seat portion of said frame and a corresponding portion of said fabric cover member; and a pair of shoulder straps connected to one of said frame and fabric cover member to allow the frame to be carried upon a person's back.

* * * * *